US005795253A

United States Patent [19]

Allen

[11] Patent Number: 5,795,253

[45] **Date of Patent: *Aug. 18, 1998**

[54] BASKETBALL GOAL RIM FOR BREAKAWAY NET ATTACHMENT SYSTEM AND METHOD OF MAKING SAME

[75] Inventor: David A. Allen, Oconomowoc, Wis.

[73] Assignee: Huffy Corporation, Miamisburg, Ohio

[ * ] Notice: The term of this patent shall not extend beyond the expiration date of Pat. No. 5,524,883.

[21] Appl. No.: 594,519

[22] Filed: Jan. 31, 1996

Related U.S. Application Data

[63] Continuation-in-part of Ser. No. 275,954, Jul. 15, 1994, Pat. No. 5,524,883.

[51] Int. Cl.[6] ..... A63B 63/08

[52] U.S. Cl. ..... 473/489; 473/485

[58] Field of Search ..... 473/485, 486, 473/489; 219/136, 137 PS

[56] References Cited

U.S. PATENT DOCUMENTS

| | | | |
|---|---|---|---|
| D. 238,284 | 12/1975 | Toedter . | |
| 1,491,286 | 4/1924 | Calhoun . | |
| 1,585,840 | 5/1926 | Fahnstock . | |
| 1,764,950 | 6/1930 | Griner . | |
| 2,199,609 | 5/1940 | Bennett . | |
| 2,254,507 | 9/1941 | Albach et al. | 473/485 |
| 2,489,174 | 11/1949 | Cunningham . | |
| 2,579,312 | 12/1951 | Garvey . | |
| 2,666,641 | 1/1954 | Bonham | 473/485 |
| 2,884,249 | 4/1959 | Cunningham . | |
| 3,194,555 | 7/1965 | Humphrey . | |
| 3,348,272 | 10/1967 | Germani . | |
| 3,582,030 | 6/1971 | Placek . | |
| 4,092,269 | 5/1978 | Hill . | |
| 4,241,916 | 12/1980 | Palm . | |
| 4,273,988 | 6/1981 | Iceland et al. | 219/137 PS |
| 4,353,548 | 10/1982 | Mahoney . | |
| 4,834,368 | 5/1989 | Qualley . | |
| 4,903,964 | 2/1990 | Anderson . | |
| 4,905,995 | 3/1990 | Apo . | |
| 4,917,340 | 4/1990 | Juemann et al. . | |
| 4,932,626 | 6/1990 | Guillot . | |
| 5,098,091 | 3/1992 | McGivern . | |
| 5,123,642 | 6/1992 | Stokes . | |
| 5,301,939 | 4/1994 | Ellsworth . | |
| 5,305,997 | 4/1994 | Jolly | 473/486 |
| 5,338,023 | 8/1994 | Stovall . | |
| 5,360,208 | 11/1994 | Fang . | |
| 5,381,588 | 1/1995 | Nelson . | |
| 5,524,883 | 6/1996 | Allen et al. | 473/485 |
| 5,575,470 | 11/1996 | Sherman | 473/489 |

FOREIGN PATENT DOCUMENTS

| | | |
|---|---|---|
| 0329893 | 8/1989 | European Pat. Off. . |
| 1214739 | 12/1970 | United Kingdom . |
| 1338325 | 11/1973 | United Kingdom . |
| 1553077 | 9/1979 | United Kingdom . |

OTHER PUBLICATIONS

Huffy Sports Parts List and Assembly Instruction Sheet, Oct. 5, 1993, and sample net clip.

Brochure, "OBO stud welding/The better solution," OBO Bettermann (Bettermann of America, Inc., Pittsburgh, PA), 11 pages, admitted prior art.

Murray, C.J. (ed.), "Plastic Net Clips Make Basketball Safer," *Design News*, May 8, 1995, p. 73.

European Search Report, EP 95 30 4948, Nov. 7, 1995.

*Primary Examiner*—Raleigh W. Chiu

*Attorney, Agent, or Firm*—Howrey & Simon; Michael J. Bell

[57] ABSTRACT

A breakaway net attachment system for mounting a basketball net to the rim of a basketball goal at predetermined locations along the rim. The system includes clips which are attachable to the rim and which include retainer portions for retaining the net in association with the rim. The rim includes a plurality of small mounting projections, which may be in the form of studs welded along an undersurface thereof for engaging within apertures formed in the clips whereby the clips are retained in engagement with the rim. In one embodiment, the clips are provided with fingers for retaining the net wherein the fingers will release the net in response to a predetermined force being applied to the net. In a further embodiment, the clip is adapted to be pulled off of the rim when a predetermined force is applied to the net.

19 Claims, 10 Drawing Sheets

BASKETBALL GOAL RIM FOR BREAKAWAY NET ATTACHMENT SYSTEM AND METHOD OF MAKING SAME

This application is a continuation-in-part of copending application Ser. No. 08/275,954, filed Jul. 15, 1994, now U.S. Pat. No. 5,524,883.

BACKGROUND OF THE INVENTION

The invention relates to a system for detachably retaining a net on a basketball goal rim whereby the net may be detached from the rim upon application of a predetermined force and, more particularly, to a basketball goal rim having small projections rigidly attached to the rim for mounting net-retaining clips on the rim.

Basketball goal nets are typically retained on the rim of a goal by attaching looped end portions of the net to hooked portions known as rams, which are typically welded to the rim of the goal by conventional resistance welding. By passing the looped portions of the net over the welded rams on the rim, the net is substantially rigidly or non-detachably retained on the rim during use of the goal, for example during a game of basketball.

Under certain circumstances it is desirable to permit the net to detach from the rim of the goal whereby a force in excess of that applied during normal play will not be conveyed through or resisted by the connection point between the net and the rim. In other words, in many instances it is desirable for the net to be capable of separating from the rim, such as when a player engages and produces a pulling force on the net, while also ensuring that the net remains engaged with the rim during the normal course of play.

In one known net attachment system, plastic ties are used to wrap around the rim and looped end portions of the net whereby the net is retained on the rim of the goal. The ends of each of the plastic ties are connected to each other and will separate from each other when a large force is applied to the net, thereby permitting the net to separate from the rim of the goal. However, such a system does not position the attachment points for the net at predetermined locations such that a uniform positioning of the attachment points along the rim is not assured. Further, when the net becomes detached from the rim the connecting ties will be freed from both the net and the rim such that they may be lost, thereby hindering reattachment of the net to the rim.

Accordingly, there is a need for a basketball goal net attachment system whereby the net may be attached to predetermined locations along the rim of a basketball goal, and which further ensures that the components of the attachment system remain associated with the system during detachment of the net from the rim.

SUMMARY OF THE INVENTION

In one aspect of the invention, a system is provided for holding a net on a basketball goal rim wherein the system generally includes a clip which is attachable to the rim, the clip including a retainer portion for retaining a portion of the net on the rim. In addition, the clip is formed with a release mechanism for releasing the net from the rim in response to the application of a predetermined force on the net. In one aspect of the invention, the retainer portion comprises elongated finger members for retaining the member on the clip. The finger members may be in the form of hook shaped elements located along alternating sides of the clip in facing relationship to each other whereby the net is retained in the clip. Alternatively, the retainer portion may comprise opposing finger members wherein one finger member includes a hook end and the opposing finger member includes a detent end for engaging the hook end whereby a passage is defined for retaining the net in engagement with the clip.

Upon application of a predetermined force, the finger members will flex and separate to permit the portion of the net engaged within the passage formed between the fingers to pass out of the passage, resulting in separation of the net from the rim.

In a further aspect of the invention, the rim is provided with small mounting projections, which may be in the form of studs rigidly attached at regular intervals along a lower portion of the rim. The studs include an enlarged head portion for engaging within an aperture formed in a base portion of the clip. The aperture may be in the form of either an elongated slot for sliding the clip into place on the stud, or in the form of a circular aperture configured to permit the clip to be pushed toward the rim causing the head of the stud to pass through the aperture.

The base of the clip is generally designed to ensure that the clip remains engaged with the rim during separation of the net from the above-described finger members. In this manner, reattachment of the net to the rim is facilitated in that the clip is retained with the system.

In a further embodiment of the invention, the retainer portion of the system comprises means defining an aperture for receiving a doubled-over looped portion of the net. The net is retained on the clip by causing the doubled-over looped end of the net to pass through the aperture and extend around the clip. In addition, the clip includes an aperture for receiving a stud rigidly mounted to the rim of the basketball goal wherein the stud includes an enlarged head. The means defining the aperture for receiving the stud is sufficiently resilient to permit the aperture to expand for permitting the clip to disengage from the rim upon application of a predetermined force. The clip is designed to remain engaged with the net such that the net may be readily reattached to the rim.

In yet a further aspect of the invention, a basketball goal rim having mounting projections particularly adapted to retain the breakaway net clips of the invention is provided. The mounting projections may be in the form of studs designed to retain the net clips on the rim. The studs are attached at spaced locations on the underside of the rim using a drawn arc stud welding process, which is quite distinct from the conventional usage of projection welded studs. Drawn arc stud welding processes have be en most commonly employed in the automotive industry where one end of a steel stud having a flat weld surface is welded to a flat sheet steel, which may be of various thickness. The basketball goal stud welding of the invention is unique in that two dissimilar parts, both in shape and material composition, are being welded together. The mounting studs of the invention preferably are formed from stainless steel having a shaft with a diameter on the order of ⅛ inch, with a flat welding surface at one end of the shaft. In the drawn arc stud welding process of the invention, this flat end surface is not welded to a flat sheet as in the conventional usage, but rather is welded to the curved circumference of the basketball goal rim, which preferably is formed from conventional solid steel rod stock having a diameter four to five times larger than the diameter of the stud.

Therefore, it is an object of the invention to provide a net retention system for a basketball goal whereby the net is detachably retained on the rim of the goal.

It is a further object of the invention to provide such a net retention system including a clip for retaining a portion of the net on the rim.

It is yet a further object of the invention to provide such a system wherein the clip is attachable to the rim of a basketball goal and wherein the net is disengagable from the clip in response to a predetermined force applied to the net.

It is another object of the invention to provide a net retention system including a clip wherein the clip is detachable from the rim of a basketball goal upon application of a predetermined force.

It is yet another object of the invention to provide a method of making a basketball goal rim having mounting projections rigidly attached thereto, which are particularly adapted for retaining the net clips of invention on the rim.

Other objects and advantages of the invention will be apparent from the following description, the accompanying drawings and the appended claims.

DETAILED DESCRIPTION OF THE PREFERRED EMBODIMENTS

Figure 1:
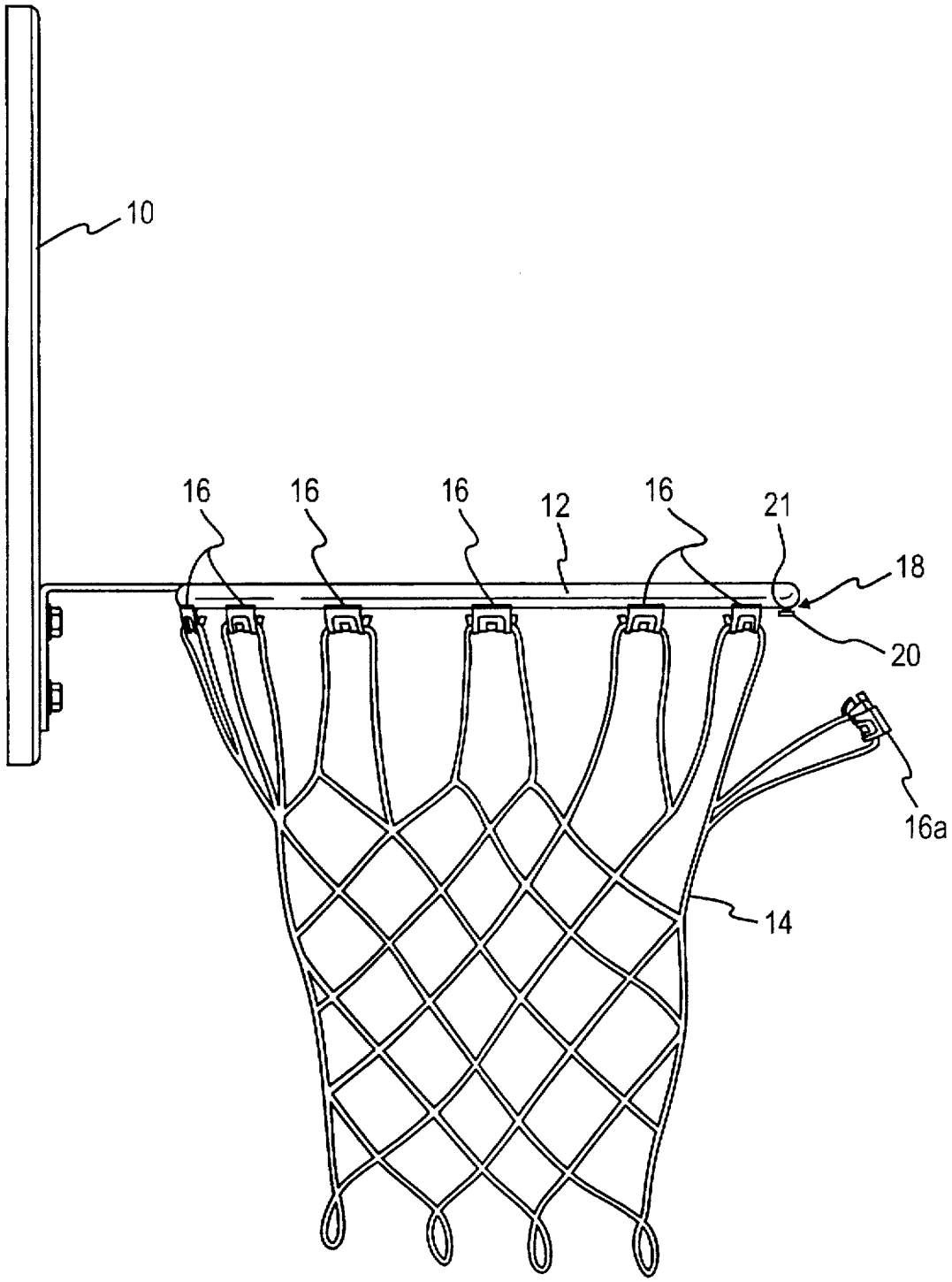
FIG. 1 is a side elevational view of a basketball goal incorporating the net retention system of the invention.

Referring to FIG. 1, the net retention system of the invention is intended to be used with a conventional basketball goal system including a backboard 10 supporting a rim 12. A net 14 is attached to the rim by a plurality of clips 16, each of the clips 16 holding a looped mounting portion of the net 14. One of the clips 16a is shown detached from the rim 12 to reveal a mounting portion for the clip in the form of a stud 18 wherein the stud includes a shaft portion 21 and an enlarged head 20 and is rigidly mounted to the rim 12 through a welded connection or the like, such as that created by the drawn arc stud welding process of the invention described in detail subsequently. Twelve of the studs 18 are located along the lower edge of the rim 12 in substantially uniformly spaced relation to each other whereby a plurality of predetermined mounting locations for the clips 16 are defined.

Referring to FIGS. 2–5, the clip 16 includes a base portion 22 and a retainer portion defined by a plurality of elongated finger members 24, 26, 28, 30 wherein the finger members 24, 30 extend from a side portion 32 of the base portion 22 and the finger members 26, 28 extend from an opposing side portion 34 of the base portion 22. Further, the finger members 26, 28 are connected to each other through a bridge portion 36.

It should be noted that the finger members 24, 26, 28, 30 are formed as hooked shaped members defining a passage 38 through the clip 16 in spaced relation to the rim 12 for receiving a portion of the net 14 wherein the net 14 may be positioned within the passage 38 by threading it over the ends of the finger members 24, 26, 28, 30.

Figure 2:
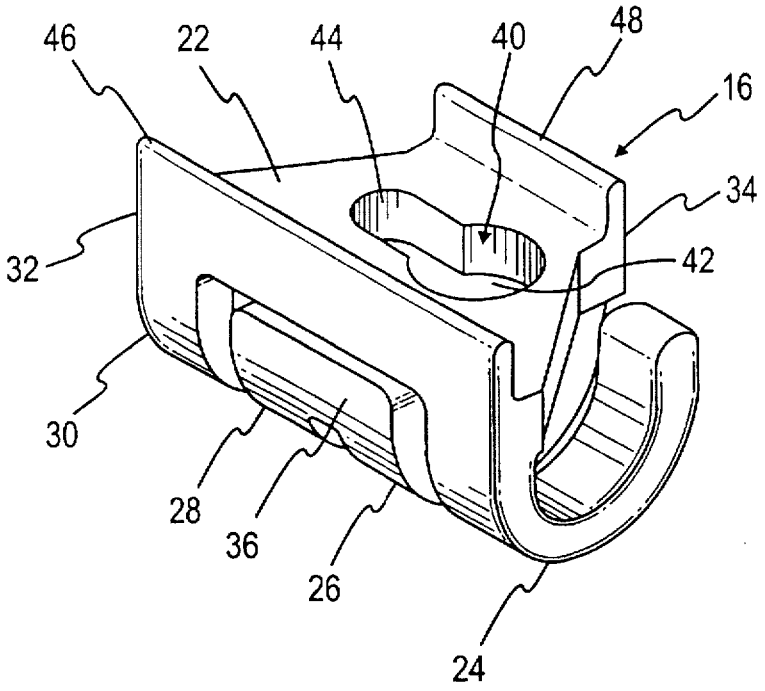
FIG. 2 is a perspective view of a clip for use in the system of the invention.
Figure 3:
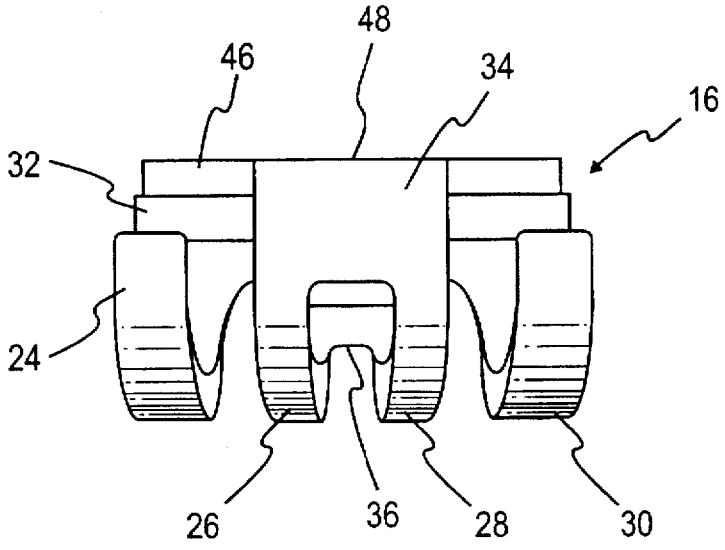
FIG. 3 is a side elevational view of the clip of FIG. 2.
Figure 4:
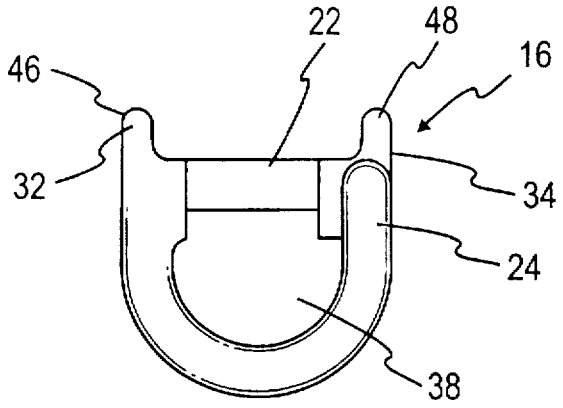
FIG. 4 is an end view of the clip of FIG. 2.
Figure 5:
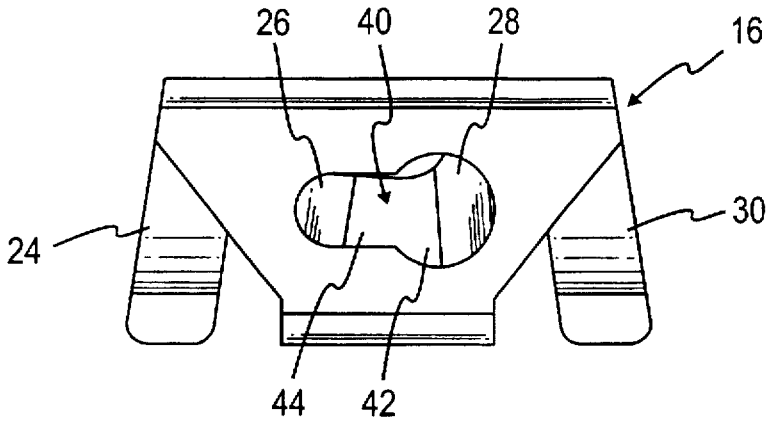
FIG. 5 is a top plan view of the clip of FIG. 2.

As seen in FIGS. 2 and 5, an engaging portion for engaging the stud 18 is defined on the base portion 22 and comprises means defining an aperture 40 through the base portion 22. The aperture 40 is in the form of a keyhole slot having an enlarged portion 42 an a neck portion 44. The enlarged portion 42 is sized to receive the enlarged head 20 of the stud 18 and the neck portion 44 is sized smaller than the head 20 of the stud 18 and is adapted to receive the shaft portion 21. Thus, the clip 16 will be held rigidly in place on the rim 12 when the stud 18 is positioned within the aperture 40 and is slid into alignment with the neck portion 44 of the aperture 40.

Figure 6:
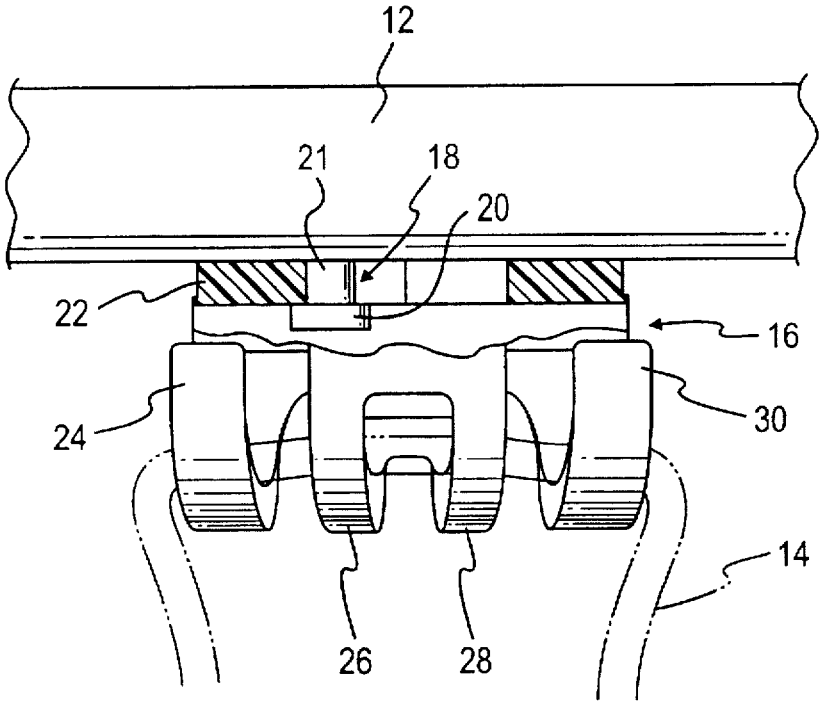
FIG. 6 is a partially cut away view showing the clip of FIG. 2 mounted to the rim of a basketball goal.
Figure 7:
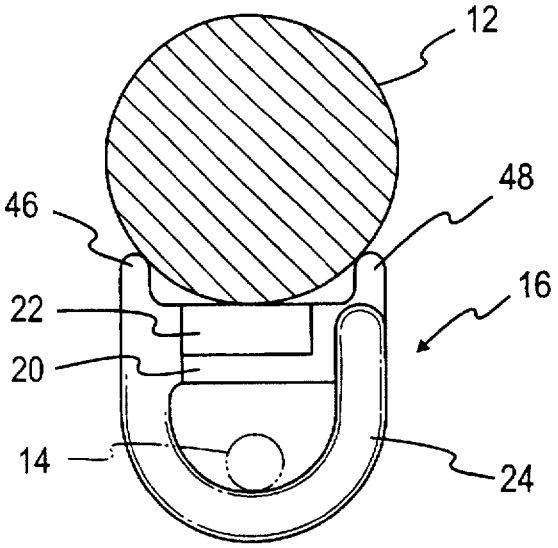
FIG. 7 is an end view of the clip of FIG. 2 mounted to the rim of a basketball goal.
Figure 8:
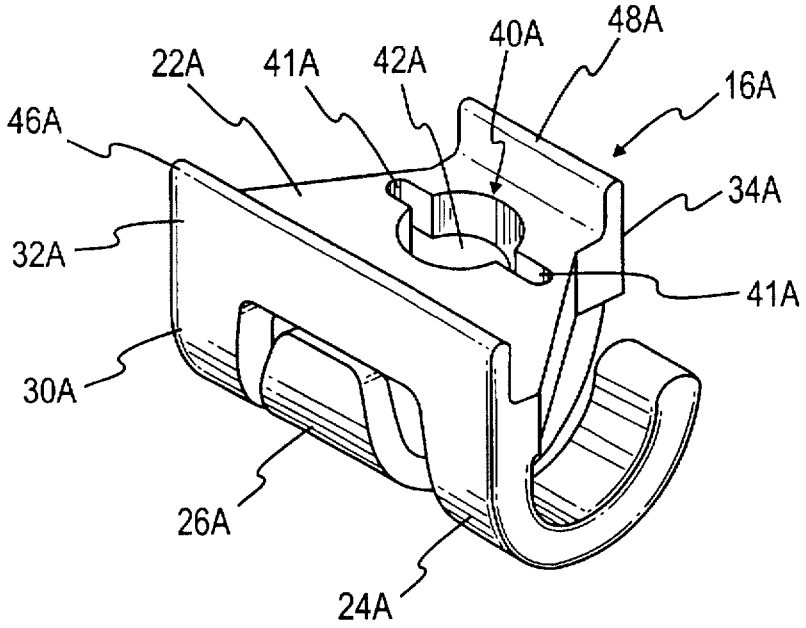
FIG. 8 is a perspective view of a second embodiment of the clip.
Figure 9:
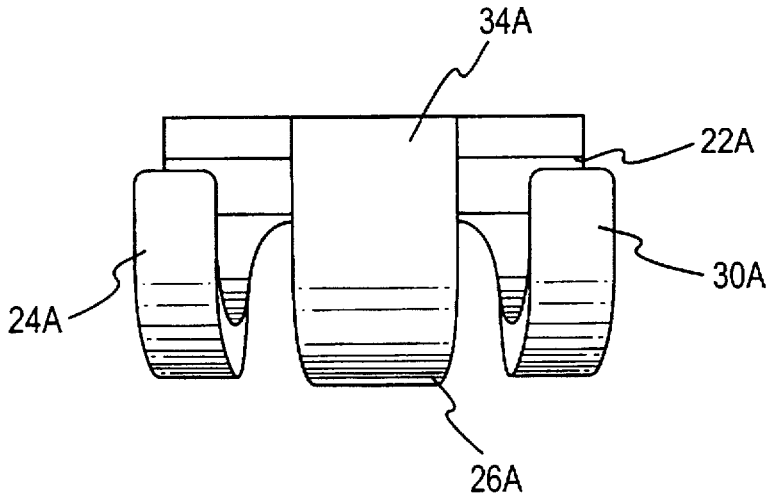
FIG. 9 is a side elevational view of the clip of FIG. 8.

Referring to FIGS. 6 and 7, the clip 16 is shown mounted to a portion of the rim 12 wherein a portion of the net 14 passes through the passage 38 defined by the finger members 24, 26, 28, 30. It should be noted that the opposing side portions 32 and 34 of the base portion 22 include upwardly extending legs 46 and 48, respectively, for engaging the rim 12 and thereby providing a stable base for the clip 16 preventing rocking and rotational movement of the clip relative to the rim 12.

In addition, it should be noted that the clip 16 is preferably formed of a resilient material, such as nylon or the equivalent, whereby the finger members further comprise a release mechanism for releasing the net 14 from the rim 12 in response to application of a predetermined force on the net 14. Specifically, the finger members are capable of moving or flexing downwardly and outwardly to permit the net 14 to pass out of the passage 38 when a predetermined force is applied on the net.

Further, as seen in FIG. 7, the clip 16 is configured such that it is smaller than the diameter of the rim 12. Thus, the clip 16 is substantially located below the rim 12 such that the top and side portions of the rim 12 are substantially unobstructed by the clip 16. The configuration for the clip 16 minimizes the possibility of a ball contacting the clip 16 during use of the net attachment system.

Referring to FIGS. 8–11, a second embodiment of the clip for the present invention is illustrated and is identified as 16A. The clip 16A is substantially similar to the clip 16 of the first embodiment and includes a base portion 22A having opposing sides 32A, 34A. Three finger members 24A, 26A, 30A are provided extending in alternating manner from the opposing sides 32A and 34A to define a net receiving passage 38A. In addition, a pair of legs 46A and 48A extend upwardly on the base portion 22A for engagement with the rim 12.

Figure 10:
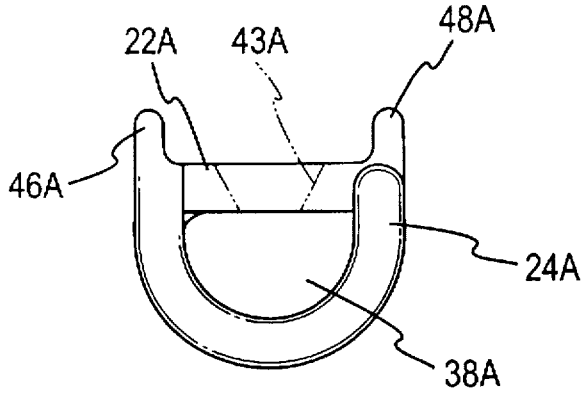
FIG. 10 is an end view of the clip of FIG. 8.
Figure 11:
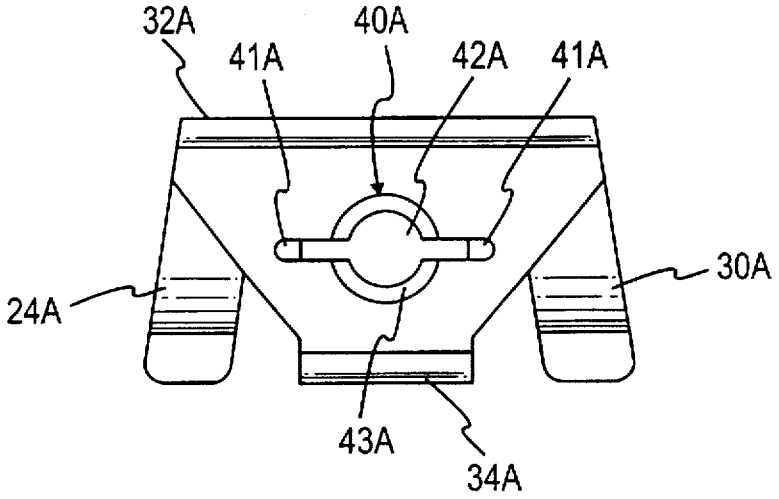
FIG. 11 is a top plan view of the clip of FIG. 8.

The clip 16A is provided with an aperture 40A including means defining a substantially circular opening 42A for receiving the stud 18. As seen in FIG. 10, the means defining the opening 42A includes sloped or tapered walls 43A to facilitate insertion of the head portion 20 of the stud 18 through the base portion 22A. In addition, narrow slotted areas 41A are provided extending radially from the open area 42A to further facilitate opening of the area 42A upon insertion of the clip past the head portion 20. Thus, the clip 16A is mounted to the rim 12 by moving the base portion 22A toward the rim 12, causing the stud 18 to pass through the aperture 40A. Further, although only two slots 41A are illustrated, it should be understood that any number of the slots 41A may be provided to facilitate mounting of the clip 16A to the rim 12.

The clip 16A operates in a manner similar to that described for the clip 16 of the first embodiment in that the finger members 24A, 26A, 30A will retain a portion of the net 14 on the rim 12 during the normal course of play, and are formed of a resilient material such that they will release the net in response to application of a predetermined force on the net 14. In addition, the area of engagement between the aperture 40A and the stud 18 is configured such that the clip 16A will be retained on the rim 12 during release of the net 14.

Figure 12:
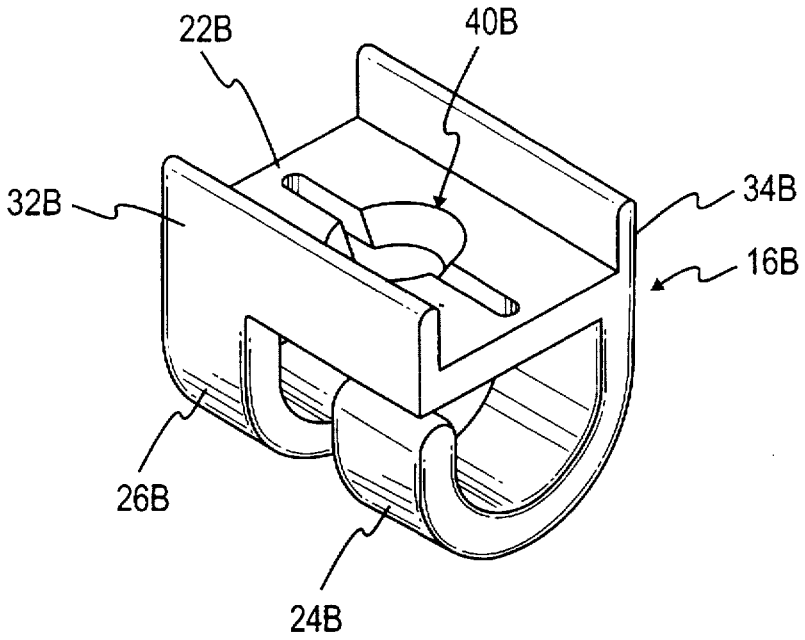
FIG. 12 is a perspective view of a third embodiment of the clip.

Referring to FIG. 12, a third embodiment of the clip is illustrated and designated as 16B. The clip 16B is substantially similar to the clip 16A of the second embodiment with the exception that only two finger members 24B, 26B are provided. The finger members 24B, 26B extend from alternate sides 32B, 34B of a base portion 22B. Further, an aperture 40B similar to aperture 40A is provided for engagement with a stud 20 on the rim 12.

It should be noted that by providing different numbers of finger members, as well as by varying the width or thickness of the finger members, the amount of force required to detach the net from the clip member may be selectively varied.

Figure 13:
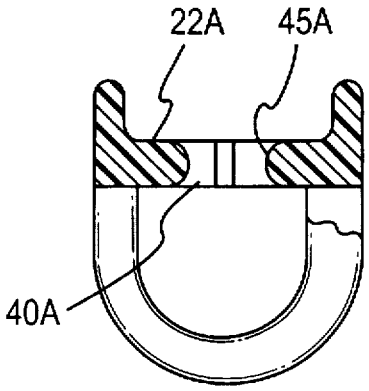
FIG. 13 is an end view of the clip of FIG. 9 partially cut away to show an alternative configuration for an aperture defining an engaging portion for a clip.

Referring to FIG. 13, an alternative configuration for the aperture 40A of the clip 16A is illustrated wherein the tapered walls 43A of the aperture 40A have been replaced with radiused walls 45A. By providing the radiused walls 45A, the clip 16A is provided with the capability of being pulled off of the stud 18 upon application of a predetermined force. In addition, the enlarged head portion 20 of the stud 18 may be designed with a taper in order to facilitate movement of the base portion 22A out of engagement with the stud 18. Thus, the clip 16A may be configured with a dual release mechanism in that, upon application of a predetermined force, either the net will separate from the finger members 24A, 26A, 30A, or the entire clip 16A will separate from the rim 12.

It should be noted that the radiused aperture illustrated in FIG. 13 may also be incorporated into the embodiment of the clip illustrated in FIG. 12 in order to provide the clip 16B with a dual release mechanism.

Figure 14:
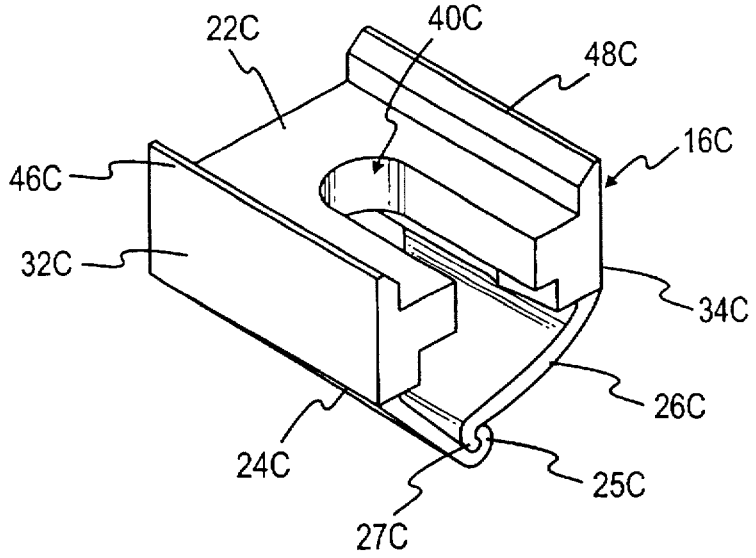
FIG. 14 is a perspective view of a fourth embodiment of the clip.
Figure 15:
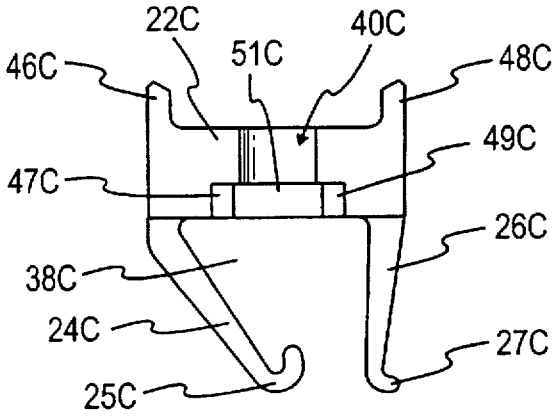
FIG. 15 is an end view of the clip of FIG. 14.
Figure 16:
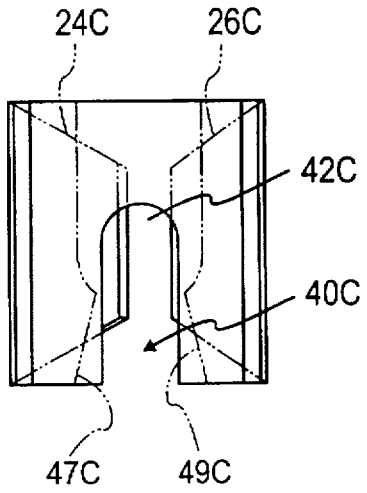
FIG. 16 is a top plan view of the clip of FIG. 14.

Referring to FIGS. 14–16, a fourth embodiment of the clip is illustrated and is designated as 16C. The clip 16C includes a base portion 22C having opposing side portions 32C, 34C supporting opposing finger members 24C and 26C respectively. The finger member 24C includes a hook end 25C and the finger member 26C includes a detent end 27C for engaging with the hook end 25C. Referring to FIG. 15, the finger members 24C and 26C are shown in a position prior to retention of the net 14 in the clip 16C. After insertion of a portion of the net 14 into the area 38C, the finger member 26C is moved toward the finger member 24C whereby the detent end 27C engages with the hook end 25C, as shown in FIG. 14.

As seen in FIGS. 14 and 16, the base portion 22C is provided with an aperture 40C in the form of an elongated slot to receive the stud 18. The slot 40C includes a lower area 51C for cooperating with the sides of the head portion 20 of the stud 18. The lower area 51C includes walls 47C and 49C angling inwardly from an open mouth of the slot 40C, and the walls 47C, 49C, define a restricted end area 42C of the slot 40C whereby the head 20 is retained in position on the clip 16C. Thus, the clip 16C is mounted to the rim 12 by sliding the clip 16C along a stud 18 until the enlarged head 20 of the stud 18 is located adjacent to the area 42C.

In use, the clip 16C is rigidly retained on the rim 12 and supports a portion of the net 14 within the passage 38C defined between the interengaged finger members 24CX and 26C. When a predetermined force is applied against the net, the finger members 24C and 26C will flex thereby causing the detent end 27C to disengage from the hook end 25C to release the net from the clip 16C.

Figure 17:
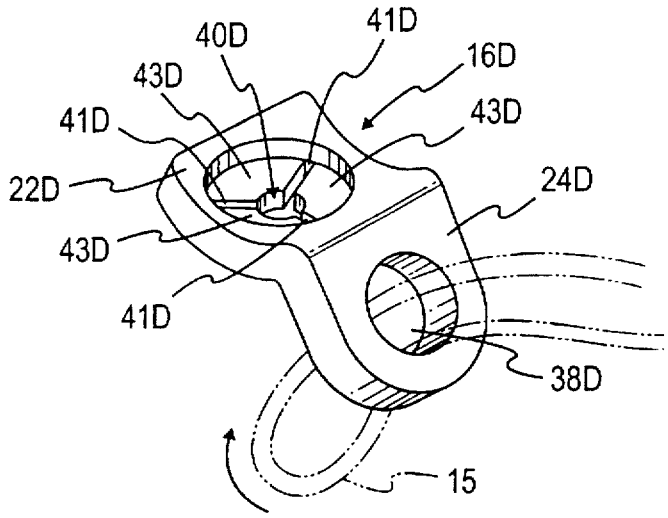
FIGS. 17–19 are perspective views of a fifth embodiment of the clip showing the steps of attaching a portion of the net to the clip.
Figure 18:
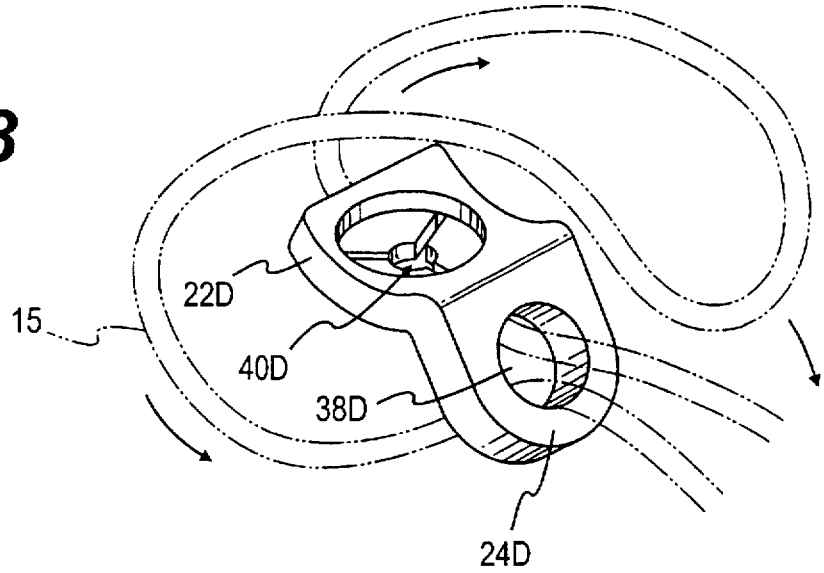
Figure 19:
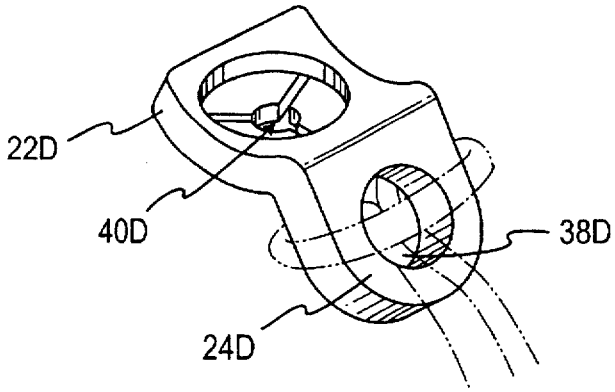

Referring to FIGS. 17–19, a fifth embodiment of the clip is illustrated and is designated 16D. The clip 16D includes a base portion 22D and retainer portion 24D. The base portion is curved to substantially match the curvature of the rim 12 and includes an engaging portion including means defining an aperture 40D and a plurality of slots 41D extending radially therefrom whereby a plurality of flexible tangs 43D are formed having end portions defining the aperture 40D. The tangs 43D flex to permit the base portion 22D to be readily attached to and detached from a stud 18 on the rim 12 upon application of a predetermined force.

The retainer portion 24D extends at an angle downwardly from the base portion 22D, and may extend substantially perpendicular to the base portion 22D. The retainer portion 24D also includes an aperture 38D for receiving a doubled-over looped portion of the net 14. The net is retained on the clip 16D by causing the doubled-over looped portion 15 to pass through the aperture 38D and extend around the retainer portion 24D of the clip 16D, as illustrated in FIGS. 17–19. Thus, upon application of a predetermined force to the net 14, the net 14 will be rigidly retained on the clip 16D and will cause the clip 16D to detach from an associated stud 18.

Figure 20:
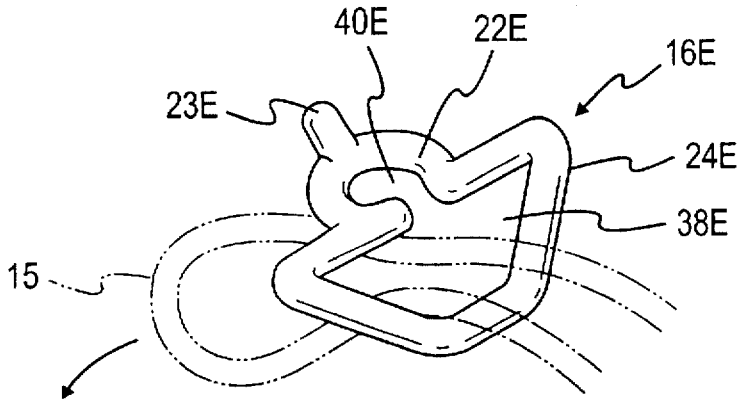
FIGS. 20–22 are perspective views of a sixth embodiment of the clip showing the steps of attaching a portion of the net to the clip.
Figure 21:
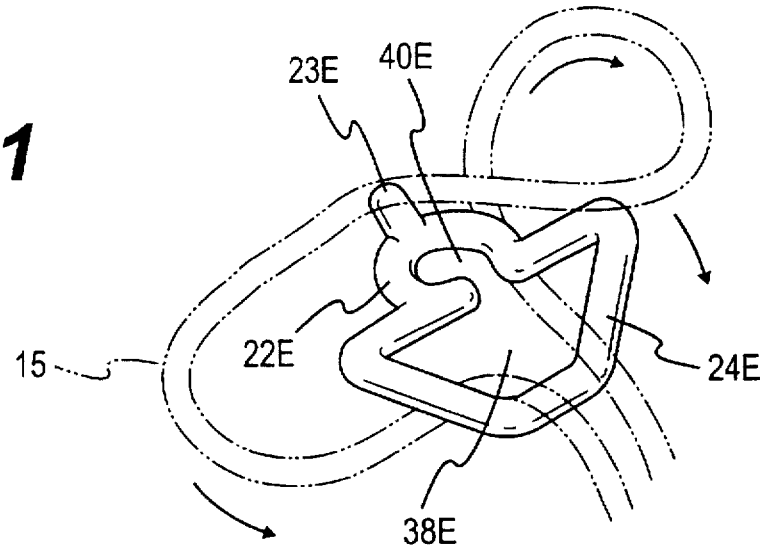
Figure 22:
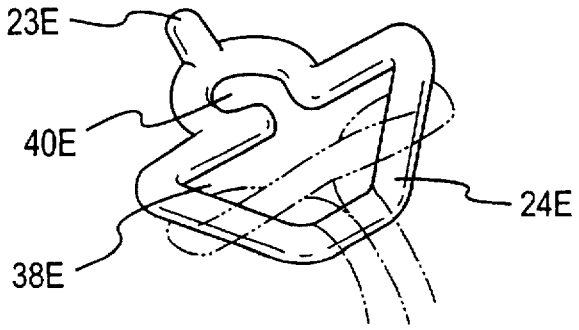

Referring to FIGS. 20–22, a sixth embodiment of the clip is illustrated designated as 16E. The clip 16E includes a base portion 22E and a retainer portion 24E. The clip 16E is formed as a substantially hollow frame member wherein the base 22E is substantially circular defining a retainer portion aperture 40E for engaging a stud 18. Thus, the aperture 40E is defined by a loop of material forming the frame member and is adapted to resiliently open to permit passage of the head 20 for the stud 18 therethrough. The base 22E also includes an outwardly extending leg 23E to provide an additional support for contacting the rim 12 and stabilizing the clip 16E. Further, the retainer portion 24E defines an aperture 38E for receiving a doubled-over looped portion 15 of the net 14. The net 14 is attached to the clip 16E in a manner similar to that described above for the fifth embodiment of the clip 16D, as illustrated in FIGS. 20–22.

The mounting studs 18 of the invention are rigidly mounted to the underside of rim 12 (as shown best in FIG. 6) by a drawn arc stud welding process in which the studs and the rim are welded together. The mounting studs of the invention may be formed from such materials as hot rolled steel, cold rolled steel, and aluminum, but preferably are formed from stainless steel, with the diameter of the shaft 21 being on the order of ⅛ inch. Stainless steel is preferred where it is important that the stud be corrosion resistant and not be susceptible to picking up a magnetic charge that could arise while the studs circulate in the delivery and escapement mechanism during the manufacturing and welding processes. The end of the shaft 21 opposite enlarged head portion 20 has a flat welding surface, which will be presented to the rim for welding. The rim preferably is formed in a conventional manner known in the art from an uncoated solid steel rod of suitable grade e.g., Grade 1008, but other materials such as hot rolled steel, cold rolled steel, and aluminum may be used also. The rod typically has a diameter on the order of ½ inch, and is formed into a ring shape suitable for use as a basketball goal or rim in a conventional manner. Thus, it is preferred that the studs and rim be dissimilar in both shape and material composition. The studs are then welded to the circumference of steel goal using a drawn arc stud welding process. In such a process, the flat end surface of a stud to be welded is positioned against the underside of the rim, which serves as the workpiece. On obtaining a work condition, a pilot arc of electricity is initiated between the stud and the goal. At a predetermined gap, the stud is lifted off the goal and a main arc of electricity is charged or drawn through the stud and the goal. After a predetermined amount of time has elapsed and the proper temperature has been reached, the flat end surface of the stud is plunged into the goal under nominal pressure, thus joining the stud and parent metal of the goal.

To facilitate the fabrication of studded basketball goal rings in accordance with the invention, the drawn arc stud welding process may be automated by suitable machinery to produce goals with twelve studs located approximately 30 degrees apart on the underside of the goal. Applicants have successfully welded stainless steel mounting studs to the circumference of a Grade 1008 steel rim having a diameter four to five times larger than the diameter of the shaft portion of the stud. Although the mounting studs are illustrated herein as having a "T"-shaped cross section, any shape stud may be welded underneath the goal as long as it adequately functions to retain the net clip on the rim within the profile of the rim so as to not interfere with a basketball during play.

From the above description, it should be apparent that the breakaway net attachment system of the invention is adapted to retain a net on a basketball goal rim in a manner which ensures that the net remains in place during normal play and which permits the net to be detached from the rim in response to the application of a predetermined force. In addition, it should be noted that the present system is particularly designed to permit a net to become detached upon the application of a force in the range of 25–50 lbs., when such force is applied to a single clip. Further, the system is adapted to release a net from a basketball goal rim when a force of 140 lbs. is applied to a net supported by a typical system incorporating twelve clips mounted to the rim.

It should also be apparent that the invention is designed to ensure that the clips for mounting the net are not lost when the net becomes detached in that the clips are designed to either remain attached to the rim or attached to a portion of the net upon detachment of the net from the rim, such that the system facilitates reattachment of the net to the rim.

Further, the attachment system of the invention provides a non-obtrusive means for attaching a net to a basketball goal rim in that the clips provided by the invention are substantially located below the rim. In this manner, the possibility of contact between the clips and a basketball is minimized.

While the forms of apparatus and processes herein described constitute preferred embodiments of this invention, it is to be understood that the invention is not limited to these precise forms, and that changes may be made therein without departing from the scope of the invention which is defined in the appended claims:

What is claimed is:

1. A basketball goal rim comprising:

a ring-shaped hoop formed from a rod of a first material having a curved outer surface; and a mounting projection formed from a second material, said mounting projection including a shaft portion and an enlarged head portion, said shaft portion being integrally connected to the curved outer surface of said hoop such that the enlarged head portion is confined within the profile of the hoop.

2. The basketball goal rim of claim 1 wherein said shaft portion includes a substantially flat surface at one end, said substantially flat surface being welded to the curved outer surface of the hoop.

3. The basketball goal rim of claim 2 wherein said shaft portion comprises a solid, cylindrical member having a predetermined diameter smaller than the diameter of the rod and said enlarged head portion comprises a disk-shaped member integrally attached to the other end of said shaft portion and having a predetermined diameter greater than the diameter of the shaft portion such that the mounting projection has a generally "T"-shaped cross section.

4. The basketball goal rim of claim 3 wherein said rod has a diameter from about 4 to about 5 times as large as the diameter of the shaft portion.

5. The basketball goal rim of claim 1 wherein said first material comprises steel, said second material comprises stainless steel, and said shaft portion is welded to said curved outer surface of said hoop.

6. The basketball goal rim of claim 1 wherein said first material and said second material have different compositions.

7. The basketball goal rim of claim 6 wherein said first material is selected from the group consisting essentially of hot rolled steel, cold rolled steel, and aluminum, and said second material is selected from the group consisting essentially of hot rolled steel, cold rolled steel, and aluminum.

8. The basketball goal rim of claim 6 wherein said shaft portion includes a substantially flat surface at one end, said substantially flat surface being welded to the curved outer surface of the hoop.

9. The basketball goal rim of claim 1 wherein a plurality of mounting projections are welded to one side of the hoop at approximately equally spaced locations.

10. The basketball goal rim of claim 1 wherein said rod has a solid, circular cross section.

11. A method of making a basketball goal rim having mounting projections integrally joined therewith at approximately equally spaced locations on one side of the rim, said method comprising the steps of:

(a) providing a ring-shaped hoop formed from a rod of a weldable, first material having a curved outer surface;

(b) providing mounting projections formed from a weldable, second material, each mounting projection including a shaft portion at one end and an enlarged head portion at its other end; and (c) welding the shaft portion of each mounting projection to the curved outer surface of the hoop at approximately equally spaced locations on one side of the hoop.

12. The method of claim 11 wherein said welding step comprises:

(i) positioning the shaft portion of each mounting projection against the curved outer surface of the hoop;

(ii) generating an arc of electricity between the mounting projection and the hoop to melt adjacent portions of the mounting projection and the hoop; and (iii) plunging the mounting projection into the hoop under nominal pressure.

13. The method of claim 12 wherein the shaft portion of each mounting projection has a substantially flat surface at one end and the step of positioning the shaft portion of each mounting projection against the curved outer surface of the hoop comprises positioning the substantially flat end surface of the projection against the curved outer surface of the hoop.

14. The method of claim 13 wherein said first material comprises steel and said second material comprise stainless steel.

15. The method of claim 14 wherein the shaft portion of the mounting projections are cylindrical in shape.

16. The method of claim 15 wherein the diameter of the rod is about 4 to about 5 times the diameter of the mounting projections.

17. The method of claim 11 wherein said welding step comprises sequentially welding a predetermined number of mounting projections to the curved outer surface of the hoop at approximately equally spaced locations on one side of the hoop.

18. The method of claim 11 wherein the first and second materials have different compositions.

19. The method of claim 18 wherein the first material is selected from the group consisting essentially of hot rolled steel, cold rolled steel, and aluminum, and the second material is selected from the group consisting essentially of hot rolled steel, cold rolled steel, and aluminum.

* * * * *